US008096016B2

(12) United States Patent
Hayashi

(10) Patent No.: US 8,096,016 B2
(45) Date of Patent: Jan. 17, 2012

(54) HOLDER FOR HOLDING A STICK-SHAPED BODY SO AS TO ADVANCE SAID BODY AND COMBINATION OF SAID HOLDER AND A STICK-SHAPED BODY

(75) Inventor: Shinichiro Hayashi, Nara (JP)

(73) Assignee: Sakura Color Products Corporation (JP)

( * ) Notice: Subject to any disclaimer, the term of this patent is extended or adjusted under 35 U.S.C. 154(b) by 1163 days.

(21) Appl. No.: 11/886,041

(22) PCT Filed: Mar. 15, 2006

(86) PCT No.: PCT/JP2006/305083

§ 371 (c)(1),
(2), (4) Date: Sep. 10, 2007

(87) PCT Pub. No.: WO2006/098348

PCT Pub. Date: Sep. 21, 2006

(65) Prior Publication Data

US 2008/0168617 A1 Jul. 17, 2008

(30) Foreign Application Priority Data

Mar. 15, 2005 (JP) ..... 2005-073696

(51) Int. Cl.
*B43L 19/00* (2006.01)

(52) U.S. Cl. ..... 15/433; 15/425

(58) Field of Classification Search ..... 15/425, 15/429, 433, 434
See application file for complete search history.

(56) References Cited

U.S. PATENT DOCUMENTS

| | | | | | |
|---|---|---|---|---|---|
| 1,451,933 | A | * | 4/1923 | Weig | 15/434 |
| 2,541,401 | A | * | 2/1951 | Burns | 15/433 |
| 5,362,166 | A | * | 11/1994 | Yamamoto et al. | 401/93 |

FOREIGN PATENT DOCUMENTS

| | | | |
|---|---|---|---|
| EP | 0 280 220 | A1 | 8/1988 |
| EP | 0 850 784 | A2 | 7/1998 |
| JP | 56-90526 | | 12/1954 |
| JP | H02(1990)-068052 | A | 3/1990 |
| JP | 2-117198 | | 9/1990 |
| JP | 3-23493 | | 3/1991 |
| JP | 5-9988 | | 2/1993 |
| JP | 2006-056152 | | 3/2006 |

* cited by examiner

*Primary Examiner* — Randall Chin
(74) *Attorney, Agent, or Firm* — Wood, Phillips, Katz, Clark & Mortimer

(57) ABSTRACT

There is provided a stick-shaped body advancing holder or a combination of a holder and an eraser adapted to advance a stick-shaped body and to ensure chucking of the body or the eraser without enlargement of the entire configuration. A stick-shaped body advancing holder has an outer barrel, an inner barrel, and urging members, the urging members each being of a sawtooth shape and having bent portions. The urging members are arranged in a gap between flat faces of the outer barrel and flat faces of the inner barrel. On a knocking operation, the bent portions are deformed, thereby generating an urging force.

19 Claims, 5 Drawing Sheets

HOLDER FOR HOLDING A STICK-SHAPED BODY SO AS TO ADVANCE SAID BODY AND COMBINATION OF SAID HOLDER AND A STICK-SHAPED BODY

BACKGROUND OF THE INVENTION

1. Field of the Invention

The present invention relates to a holder for holding a stick-shaped body such as a rubber eraser so as to advance (intermittently feed) the body and to a stick-shaped body with the above-mentioned holder (combination of the holder and a stick-shaped body).

2. Description of the Related Art

Technology relating to stick-shaped body advancing holders is conventionally disclosed. The holders each arranges a stick-shaped eraser within a tubular holder body and is adapted to advance the eraser by a knocking operation in which its proximal end is pushed.

The stick-shaped body used in such holders has various kinds of cross sectional shapes that are other than circular; such as rectangular. In the case of the body having a noncircular cross sectional shape, such as rectangular, even if torque is generated between the stick-shaped body and the holder, they have no relative rotation, so that a rotational position of the body is normally fixed.

Such conventional art is disclosed in the patent documents 1 and 2 described below.

Patent Document 1: JP 2-117198 U

Patent Document 2: JP 3-23493 U

SUMMARY OF THE INVENTION

Problems to be Solved by the Invention

Such an advancing holder is provided with an inner barrel, an outer barrel, and an urging member for urging the inner barrel toward a proximal end. Herein, in a holder of the present application, a direction in which a stick-shaped body is advanced (adjacent to a paper when used in the case of an eraser holder) is designated a distal end, whereas the other direction is designated a proximal end. The inner barrel is moved by a predetermined length relative to the outer barrel. When not in operation, the body is held by a chuck arranged in the inner barrel, being prevented from being moved.

When the inner barrel is moved toward the distal end by an operation such as pushing of a knocking part, a stick-shaped body is advanced toward the distal end along with movement of the inner barrel, whereupon holding of the body by the chuck is released at a position just before a stopping position of the inner barrel. When the knocking part is no longer pushed, an urging force caused by the urging member retracts the inner barrel toward the proximal end, while maintaining a condition in which the holding by the chuck is released up to a predetermined position (where the chuck restarts holding).

The position where the holding by the chuck is released when the proximal end is pushed is located at a distal side of the position where the holding by the chuck is restarted when the proximal end is no longer pushed. Thus, one knocking operation advances the body toward the distal end a different length between the positions.

The stick-shaped body and the outer barrel have a partial contact with each other, so as to generate a frictional resistance, which restricts relative movement between the body and the outer barrel when the holding by the chuck is released. Therefore, only when the chuck holds the body, relative movement between the body and the outer barrel is allowed.

In this way, the advancing holder requires the urging member so as to retract the inner barrel toward the proximal end. Since the holding and releasing of the stick-shaped body by the chuck is allowed by relative movement by the knocking operation, the stronger the urging force caused by the urging member is, the stronger a chuck force (force for holding of the stick-shaped body) caused by the chuck is.

In the case of the body having a circular cross sectional shape, an inner barrel and an outer barrel both of a circular shape can be used with a circular compression coil spring as the urging member arranged between the inner and the outer barrels in such a manner that the spring is wound around the inner barrel. Such an arrangement of the urging member makes the entire configuration of the holder smaller relative to the cross sectional shape of the stick-shaped body, thereby enabling miniaturization of the holder.

However, in the case of the body having a noncircular cross section, such an arrangement of a circular coil spring between the inner and the outer barrels results in enlargement of the cross sectional shape of the entire holder. If a compression coil spring in accordance with the cross sectional shape of the stick-shaped body is intended to be put in use, it is difficult to manufacture such a spring and impossible to manufacture a spring having a large spring constant, resulting in insufficient enlargement of the above-mentioned chuck force.

By an arrangement of the urging member at the proximal end of the inner barrel, a spring having a large spring constant can be used, but the stick-shaped body cannot be supplied from the proximal end of the inner barrel and is supplied only from the distal end, resulting in difficulty in supplying of the body.

It is an object of the present invention therefore to provide a stick-shaped body advancing holder or a combination of the holder and a stick-shaped body (a combination of the holder and a rubber eraser, for example) adapted to ensure a chuck without enlargement of the entire configuration.

Means to Solve the Problem

An aspect of the present invention provided herein for achieving the object described above is a holder for holding a stick-shaped body so as to advance the body, including an outer barrel of a substantially tubular shape and having an inner surface, an inner barrel of a substantially tubular shape, arranged within the outer barrel, and having an outer surface, and at least one urging member arranged between the outer and the inner barrels and adapted to exert an urging force on the inner barrel relative to the outer barrel in a predetermined direction, wherein the holder is adapted to perform a back and forth operation in which the inner barrel is moved against the urging force by an external force and reverts to the previous position by the urging force thereafter, the back and forth operation being adapted to advance the body placed within the inner barrel, wherein the urging member has a plurality of bent portions, the portions being deformable to generate the urging force, and wherein the inner surface of the outer barrel and the outer surface of the inner barrel each have at least one flat face, the urging member being arranged between the flat faces of the both surfaces.

An urging member used in the holder has bent portions, which is deformed to generate an urging force. An outer barrel and an inner barrel each has a flat face, so that the urging member is arranged between the flat face of the outer barrel and the flat face of the inner barrel. Thus, even with a narrow gap between the holder and a stick-shaped body, a large urging force is generated. That ensures chucking and advancing of the body without enlarging the entire configuration of the holder.

In the holder of the present aspect, the urging member has preferably a wave shape. In this specification, a term "wave shape" includes a sawtooth wave shape and a zigzag shape.

The urging member is preferably made of a body selected from a wire and a plate having a shape bent in a plurality of portions with alternating a bending direction in a same plane.

The urging member may be manufactured appropriately by a known method.

More preferably, the urging member is manufactured by bending a body selected from a wire and a plate in repeating fashion with alternating a bending direction in a same plane.

By such a method of manufacturing the urging member, the urging member is readily manufactured.

Preferably, the holder of the present aspect has at least two of the urging members, wherein the outer barrel has at least two of the flat faces on the inner surface and the inner barrel has at least two of the flat faces on the outer surface, so that two of the urging members are arranged at opposed positions between the flat faces of the outer and the inner barrels.

According to such a configuration, two of the urging members are arranged at opposed positions, so as to generate the urging force in a balanced manner.

Further, the holder of the present aspect preferably has at least two of the urging members, wherein the outer and the inner barrels each is of a rectangular tubular shape, and wherein the outer barrel has four of the flat faces on the inner surface and the inner barrel has four of the flat faces on the outer surface, so that two of the urging members are arranged at opposed positions between the flat faces of the outer and the inner barrels.

Also according to such a configuration, two of the urging members are arranged at opposed positions, so as to generate the urging force in a balanced manner. Further, the outer and the inner barrels each is of a rectangular tubular shape, so as to be readily manufactured.

Still further, the holder of the present aspect preferably has at least two of the urging members, wherein the outer and the inner barrels each is of a rectangular tubular shape having four flat plates, so that two of the urging members are arranged at opposed positions between the flat plates of the outer and the inner barrels.

Also according to such a configuration, two of the urging members are arranged at opposed positions, so as to generate the urging force in a balanced manner. Further, the outer and the inner barrels each is of a rectangular tubular shape having four flat plates, so as to be readily manufactured and be compact.

In the holder of the present aspect, it is preferable that the outer barrel has a longitudinal direction, includes a first part and a second part arranged in the longitudinal direction, and defines an internal space, that the outer barrel has a rectangular cross sectional shape of the internal space in each of the parts in cutting the outer barrel at a plane perpendicular to the longitudinal direction, the first part having at least one side larger than that of the second part, and that the urging member is arranged between the inner barrel and the first part of the outer barrel.

According to such a configuration, the urging member is stably arranged.

In the holder of the present aspect, it is preferable that the inner barrel has a protrusion on the outer surface, so that the urging member exerts the urging force on the inner barrel by contacting the protrusion.

Such a configuration simplifies a structure of the holder by which the urging member exerts the urging force on the inner barrel.

It is particularly preferable that the outer barrel has a step between the first and the second parts, that the inner barrel has a protrusion on the outer surface, and that the urging member is arranged between the step and the protrusion, so as to exert the urging force on the inner barrel by contacting with the protrusion.

According to such a configuration, the urging member is sandwiched between the step of the outer barrel and the protrusion of the inner barrel, thereby exerting the urging force on the protrusion of the inner barrel. That simplifies a structure of the holder.

In the holder of the present aspect, it is preferable that the flat face of the inner barrel has a plurality of longitudinal ribs, and that the urging member is arranged between the ribs and the outer barrel.

According to such a configuration, arrangement of the urging member on the ribs reduces a contacting area of the urging member and the inner barrel, thereby reducing a frictional resistance. That allows a smooth movement and deformation of the urging member in accordance with movement of the inner barrel.

Preferably, the holder of the present aspect further includes an operating member and a tube for a chuck, the operating member being adapted to transmit the external force to the inner barrel, and the tube being arranged between the inner and the outer barrels and being adapted to move in cooperation with the inner barrel, so as to advance the stick-shaped body by fastening and releasing of the body in accordance with the back and forth operation of the inner barrel.

Such a configuration facilitates an operation for advancing the body. A specific configuration of the operating member or the tube for advancing the body may be selected from the known art.

Another aspect of the present invention is a combination of one of the above-mentioned holders and a stick-shaped body held in the holder, wherein the stick-shaped body decreases in length by use. In other words, it is a stick-shaped body with a holder.

Such a configuration contributes to the continued use of the stick-shaped body by advancing the body in the case that the body has decreased in length by use. Even in the case of a narrow gap between the holder and the body, a large urging force is generated, thereby ensuring chucking and advancing the body without enlarging the entire configuration of the holder.

In the present aspect, the stick-shaped body is preferably of a rectangular bar.

Such a configuration maintains a rotational position of the body and prevents rotation of the body against users' will.

In the present aspect, the stick-shaped body may be a rubber eraser.

Advantageous Effect of the Invention

The stick-shaped body advancing holder or the combination of the above-mentioned holder and a stick-shaped body of the present invention ensures chucking the body without enlargement of the entire configuration of the holder.

DESCRIPTION OF THE PREFERRED EMBODIMENT

Now, an embodiment of the present invention will be described below in detail, making reference to the accompanying drawings.

In this specification, a term "cross sectional shape" denotes a shape of cross section formed by a plane perpendicular to a longitudinal direction/axis x (FIG. 1) of a stick-shaped body, if not otherwise specified.

Figure 1:
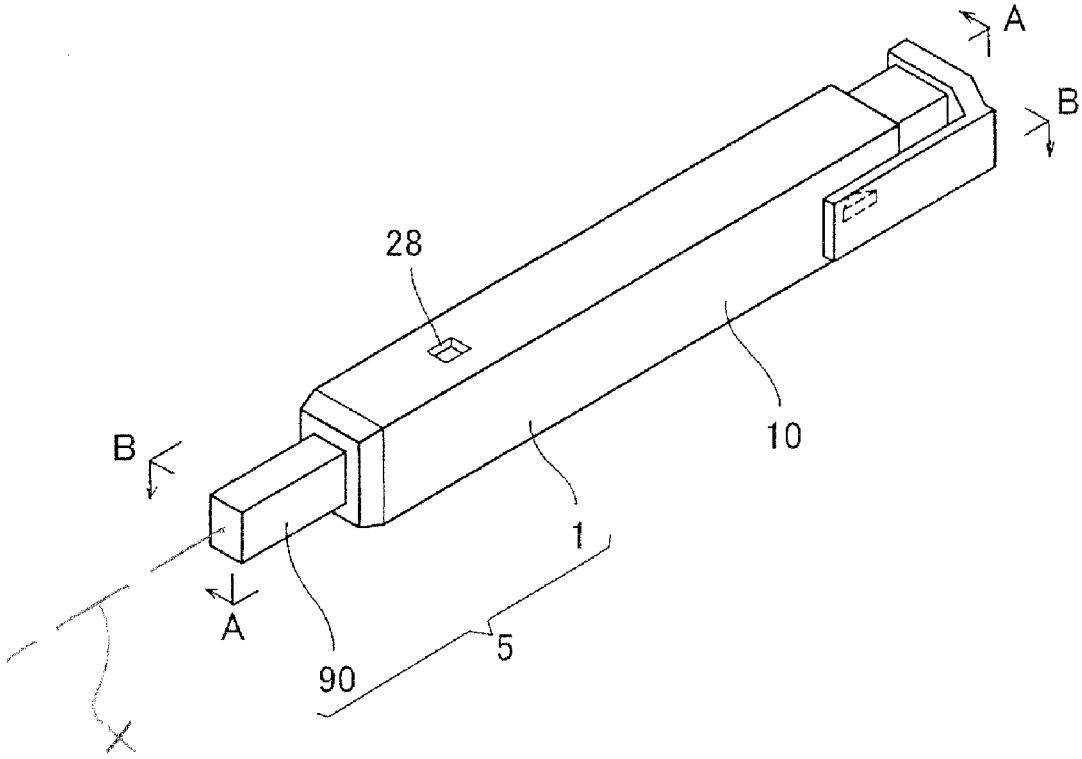
FIG. 1 is a perspective view of a combination of a holder and an eraser of an embodiment of the present invention.

A stick-shaped body advancing holder 1 of an embodiment of the present invention, which is shown in FIG. 1, is adapted to hold a stick-shaped body 90. The holder 1 holds the body 90, thereby constituting a combination of a holder and an eraser (a combination of a holder and a stick-shaped body) 5. The combination 5 is adapted to advance the held body 90 by a knocking operation. The body 90 is an elongated body of a rectangular cross sectional shape.

Figure 2:
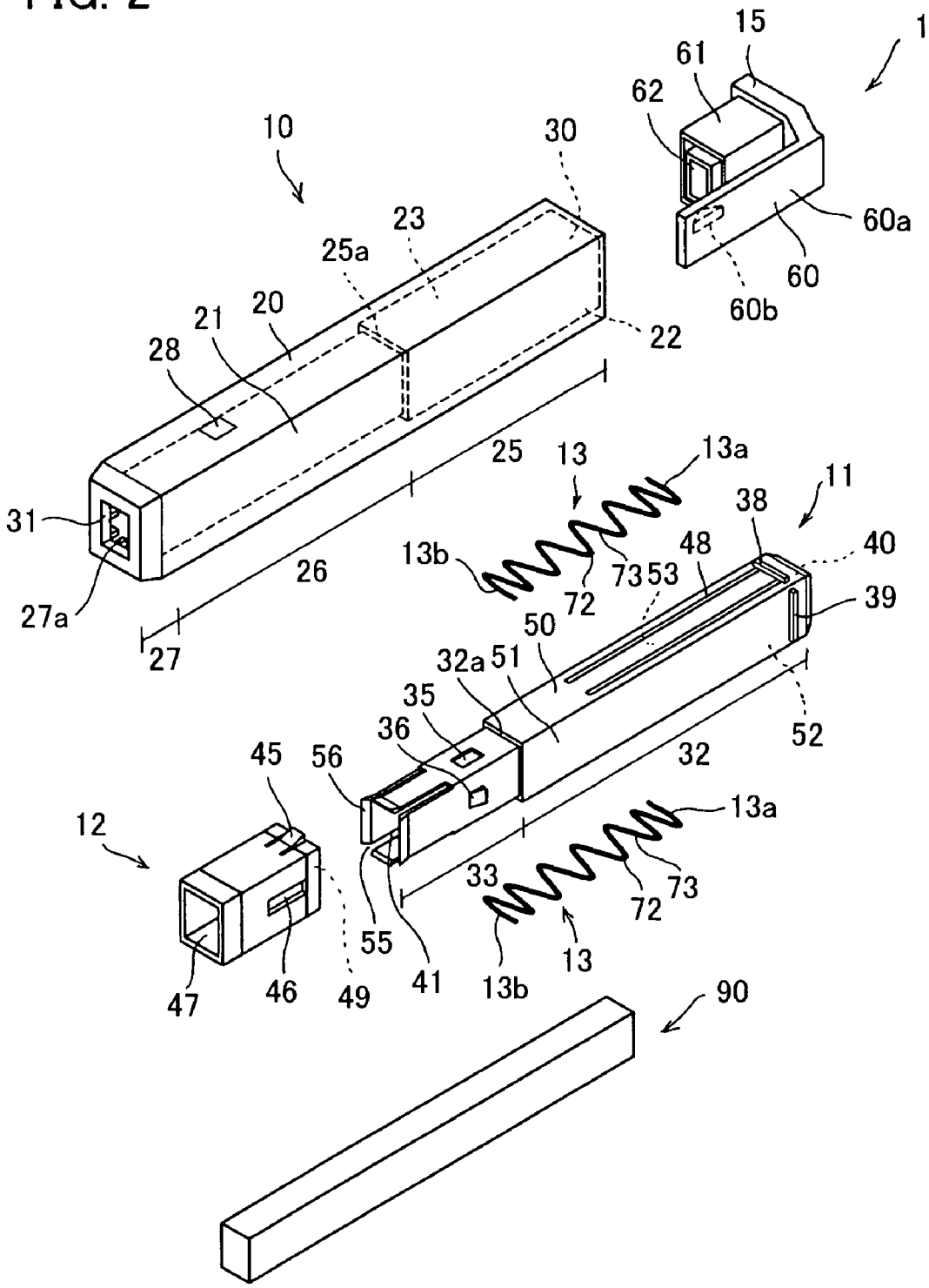
FIG. 2 is an exploded perspective view of the combination in FIG. 1.
Figure 3A:
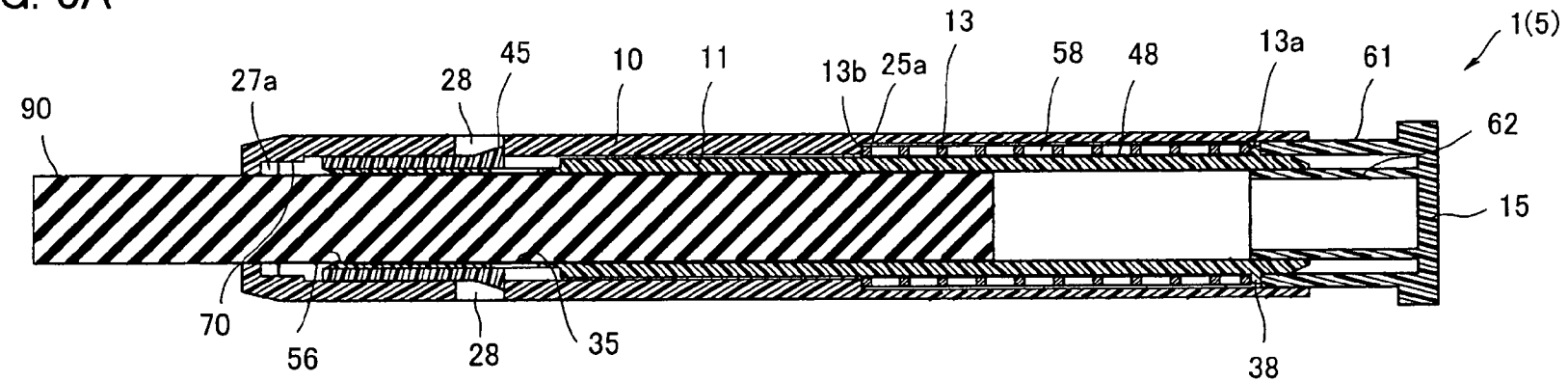
FIGS. 3A and 3B each is a cross section of the combination in FIG. 1, FIG. 3A being a cross section taken along a line A-A, and FIG. 3B being a cross section taken along a line B-B.
Figure 3B:
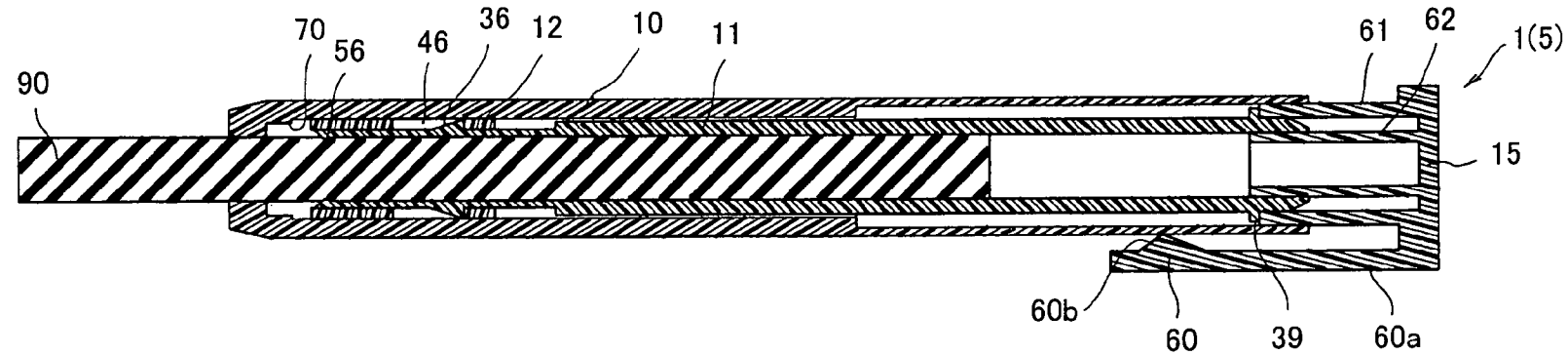
Figure 4A:
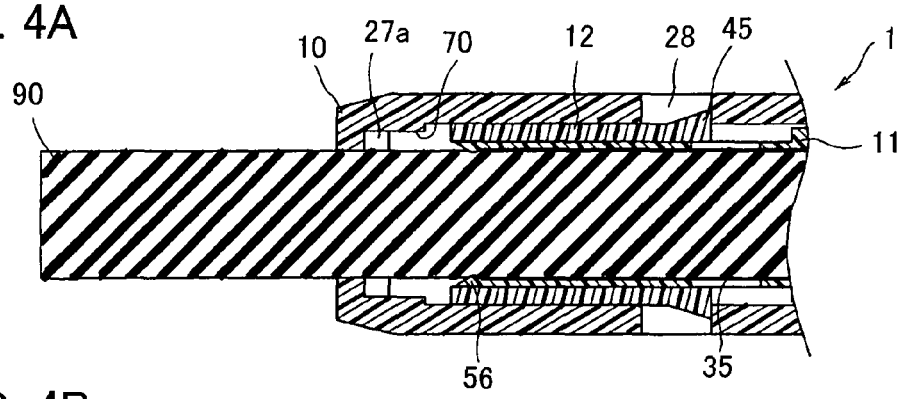
FIGS. 4A and 4B each is a cross section in the vicinity of a distal end of the combination of the present invention, FIG. 4A being an enlarged cross section of FIG. 3A, and FIG. 4B being an enlarged cross section of FIG. 3B.
Figure 4B:
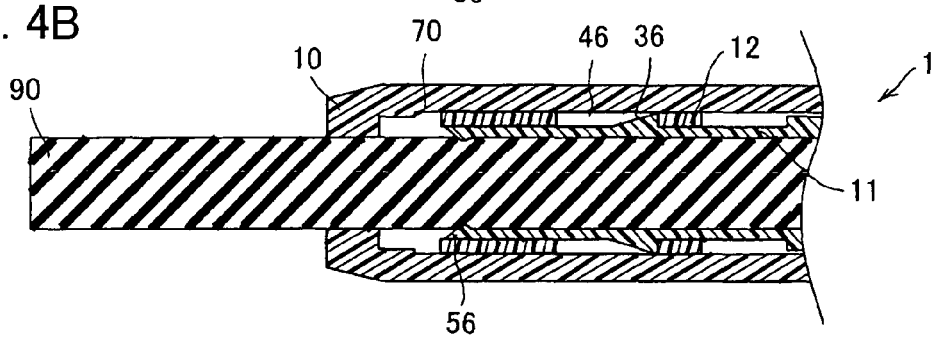

Referring to FIGS. 2, 3A and 3B, the holder 1 includes an outer barrel 10, an inner barrel 11, a chuck tube (tube for a chuck) 12, urging members 13, and an operating member 15. The outer barrel 10, the inner barrel 11, the chuck tube 12, and the operating member 15 are made of resin by resin molding. The urging members 13 are made of metal and each extends only partially around the axis x.

The outer barrel 10, the inner barrel 11, and the chuck tube 12 each is a substantially rectangular hollow tube. The outer barrel 10 is formed by four flat plates with a proximal opening 30 at its proximal end, i.e., adjacent to the operation member 15, and a distal opening 31 at its distal end, i.e., adjacent to the chuck tube 12, defining a throughhole therewithin. The inner barrel 11 and the chuck tube 12 are placed within the outer barrel 10. Further, the outer barrel 10 has four flat faces 20, 21, 22, and 23 on its inner surface. Among the flat faces 20, 21, 22, and 23, the flat faces 20 and 22 are opposed to each other and the flat faces 21 and 23 are opposed to each other. A pair of the opposed flat faces 20 and 22 has therebetween a width smaller than that between the other pair of the opposed flat faces 21 and 23.

The outer barrel 10 has a first part 25, a second part 26, and a stick-shaped body contacting part 27 arranged in a longitudinal direction.

The first part 25 defines an internal space of a rectangular cross sectional shape, which is substantially the same shape over its entire length and which is larger than an outer shape of a main part 32 (described below) of the inner barrel 11. In the outer barrel 10, at least one side of the rectangular cross sectional shape of the internal space of the first part 25 is larger than a corresponding side of a rectangular cross sectional shape of an internal space defined by the second part 26. As the inner barrel 11 is inserted into the outer barrel 10, the first part 25 and the main part 32 define a gap 58 therebetween, in which the urging members 13 are positioned.

Because of a dimensional difference between the cross sectional shapes of the internal spaces of the first and the second parts 25 and 26, the outer barrel 10 has a step 25*a* at the boundary of the first and the second parts 25 and 26. The step 25*a* is a part to contact with ends 13*b* of the urging members 13 described below.

The second part 26 defines the internal space of a rectangular cross sectional shape, which is substantially the same shape over its entire length, as described above. Sizes in height and width thereof are substantially the same as or slightly larger than those of the outer shapes of the main part 32 (described below) of the inner barrel 11 and of the chuck tube 12, and are larger than those of a distal part 33 of the inner barrel 11. As the inner barrel 11 is inserted into the outer barrel 10, part parts of the main part 32 and the distal part 33 of the inner barrel 11 are positioned in the second part 26 of the outer barrel 10.

Further, the second part 26 has throughholes 28 formed in a direction perpendicular to the longitudinal direction and penetrating through the inside and outside of the outer barrel 10. Though described in detail below, protrusions 45 formed on the chuck tube 12 are designed to come into the throughholes 28 when the chuck tube 12 is inserted into the outer barrel 10, so as to retain the chuck tube 12 in the outer barrel 10.

The stick-shaped body contacting part 27 defines an internal space having sizes in height and width smaller than those of the first and the second parts 25 and 26. The contacting part 27 has a plurality of ribs 27*a* inwardly projecting. Inner ends of the ribs 27*a* are to be brought into contact with the stick-shaped body 90, so as to generate friction between the ribs 27*a* and the body 90 when the body 90 is moved.

The internal spaces of the first part 25, the second part 26, and the contacting part 27 are united as part of the outer barrel 10, having the proximal opening 30 and the distal opening 31 positioned at opposite ends thereof.

Referring to FIGS. 2, 3A, and 3B, the inner barrel 11 is a rectangular hollow tube and is designed to receive the stick-shaped body 90 therewithin. The inner barrel 11 is formed by four flat plates and has four flat faces 50, 51, 52, and 53 on its inner surface. Among the flat faces 50, 51, 52, and 53, the flat faces 50 and 52 are parallel to each other and the flat faces 51 and 53 are parallel to each other. A pair of the parallel flat faces 50 and 52 has a width smaller than that of the other pair of the parallel flat faces 51 and 53. Its cross sectional shape is a rectangle, in which sides corresponding to the flat faces 51 and 53 are longer.

The inner barrel 11 defines an internal space extending in a longitudinal direction and having the substantially same cross sectional shape with an outer shape of the stick-shaped body 90, with a proximal opening 40 at its proximal end, i.e., adjacent to the operation member 15, and a distal opening 41 at its proximal end, i.e., adjacent to the chuck tube 12.

The inner barrel 11 has the main part 32 and the distal part 33, the latter having a dimension smaller than the former. Further, the inner barrel 11 has a step 32*a* at the boundary of the main part 32 and the distal part 33.

The main part 32 has ribs 38 and 39 outwardly projecting, the ribs 38 projecting from the flat faces 50 and 52 of the outer surface of the inner barrel 11, and the ribs 39 projecting from the flat faces 51 and 53 of the outer surface. The ribs 38 and 39 are situated adjacent to the proximal opening 40 and contact an outer cylindrical part 61 (described below) of the operating member 15, so as to transmit a force to the inner barrel 11 from the operating member 15 in a knocking operation to advance the inner barrel 11.

On the other hand, the urging members 13 contact the ribs 38 formed on the flat faces 50 and 52 having smaller width, the ribs 38 exerting an urging force, which is generated by the compressed urging members 13, on the inner barrel 11. The urging members 13 are positioned at the gap 58 between the step 25*a* of the outer barrel 10 and the ribs 38 of the inner barrel 11 and each extends only partially around the axis x.

On each of the flat faces 50 and 52, two ribs 48 are longitudinally formed in an area where the urging member 13 is placed. Arrangement of the urging members 13 on the ribs 48 reduces a contacting area of the urging members 13 and the inner barrel 11, thereby reducing a frictional resistance therebetween. That allows smooth movement and deformation of the urging members 13 in accordance with movement of the inner barrel 11.

The distal part 33 has throughholes 35, protrusions 36, and slots 55. The throughholes 35 are formed on the flat faces 50 and 52 having smaller width and at positions penetrating through inside and outside of the inner barrel 11 and in the vicinity of the throughholes 28. The throughholes 35 facilitate inward deformation of the protrusions 45 of the chuck tube 12, thereby facilitating assembling the holder 1 or disassembling the holder 1 after assembly.

The protrusions 36 are formed on the flat faces 51 and 53, having larger width, protruding outwardly. As shown in FIG. 3B, the protrusions 36 are to be positioned in elongated holes 46 of the chuck tube 12 so as to protect the inner barrel 11 from being detached from the chuck tube 12 in a condition in which the holder 1 is assembled. Herein, the protrusions 36 each has a slope outwardly enlarged toward the main part 32 so as to facilitate insertion of the inner barrel 11 into the chuck tube 12.

The slots 55 are positioned from the distal opening 41 to a predetermined position of the distal part 33 on edges each formed by adjoining faces among the four flat faces 50, 51, 52, and 53. Inward addition of a force in the vicinity of the distal opening 41 deforms and curves the flat faces 50, 51, 52, and 53.

The inner barrel 11 further has a chuck 56 adjacent to the end of the distal opening 41 of the four flat faces 50, 51, 52, and 53. Referring to FIGS. 2, 3A, and 3B, the chuck 56 has an outer shape extending outward toward the distal opening 41, thereby allowing the chuck 56 to smoothly pass through the inside of the chuck tube 12 in a knocking operation.

The chuck tube 12 is a rectangular hollow tube shorter than the distal part 33 of the inner barrel 11, having openings 47 and 49 at opposite ends thereof, the protrusions 45 protruding outward, and the elongated holes 46 extending in a longitudinal direction. The chuck tube 12 and the inner barrel 11 cooperate so as to advance the stick-shaped body 90 by chucking and releasing of the body 90 in accordance with a back and forth movement of the inner barrel 11. As shown in FIGS. 3A and 3B, the chuck tube 12 is positioned between the distal part 33 of the inner barrel 11 and the second part 26 of the outer barrel 10. At this time, the opening 47 comes adjacent to the contacting part 27 (a distal side) of the outer barrel 10, whereas the opening 49 comes adjacent to the first part 25 (a proximal side) of the outer barrel 10.

The protrusions 45 are inserted into and engaged with the throughholes 28 of the outer barrel 10, so that the chuck tube 12 is retained in the outer barrel 10. The protrusions 45 each has a slope in such a manner as protruding toward the opening 49 (a proximal side of the holder), thereby facilitating insertion of the chuck tube 12 into the outer barrel 10. The protrusions 45 each has a length in a longitudinal direction slightly shorter than that of the throughhole 28, so that the outer barrel 10 and the chuck tube 12 are relatively movable in the longitudinal direction a length therebetween.

The elongated holes 46 extend in the longitudinal direction and penetrate through inside and outside of the chuck tube 12. Arrangement of the protrusions 36 of the inner barrel 11 put into the chuck tube 12 within the elongated holes 46 restrains movement of the protrusions 36, thereby maintaining a relative position between the inner barrel 11 and the chuck tube 12 within a predetermined range.

The chuck tube 12 is relatively movable in the longitudinal direction at the distal part 33 of the inner barrel 11. In the case that the chuck 56 of the inner barrel 11 is situated within the chuck tube 12, the chuck 56 is pushed inward by the chuck tube 12, so as to chuck the stick-shaped body 90. In the case that the chuck 56 is situated out of the opening 47 of the chuck tube 12, the chuck 56 is not pushed by the chuck tube 12, so as not to chuck the 20 body 90.

In this way, in the stick-shaped body advancing holder 1 of the present embodiment, the chuck 56 selectively holds the stick-shaped body 90.

Figure 7:
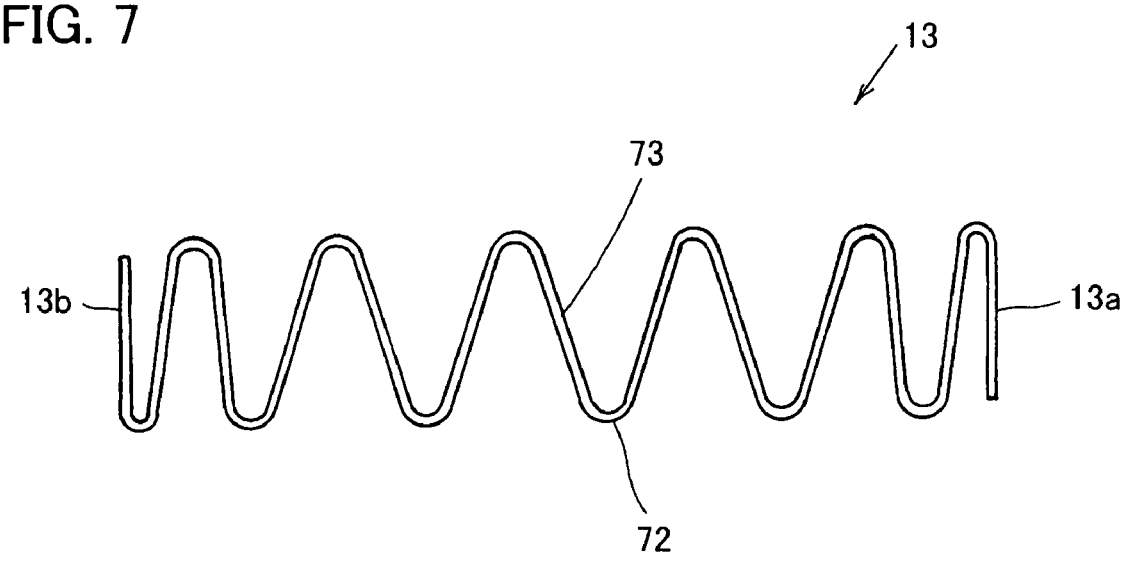
FIG. 7 is a front view of an urging member.

The urging members 13 each, as shown in FIGS. 2 and 7, has a wave shape with a plurality of bent portions 72 and a plurality of linear portions 73. Further, the urging members 13 each has a shape bent with alternating a bending direction of a wire in a same plane, i.e., in a zigzag manner. The urging members 13 each is manufactured by bending a wire with alternating a bending direction in the same plane. The wire is of a rectangular cross sectional shape, as shown in FIG. 3A.

Deformation of the urging members 13 each so as to reduce the distance between its ends 13*a* and 13*b* changes angles of the bent portions 72, so that the urging members 13 each generates an urging force and functions as a compression spring.

The two urging members 13 are arranged in the gap 58 between the flat faces 20 and 22 of the inner surface of the outer barrel 10 and the flat faces 50 and 52 of the outer surface of the inner barrel 11. The urging members 13 generate the urging force between the outer and the inner barrels 10 and 11. The urging force acts in a direction of the inner barrel 11 heading toward the operating member 15, i.e., being retracted toward the proximal end.

The urging members 13 are arranged at two positions opposite to each other so as to sandwich the inner barrel 11.

As described above, the urging members 13 each is not sterically bent but in a two-dimensional shape, so as to have a width substantially equal to a width of the wire. Thus, unlike in the case of a coil spring, the urging members 13 are placed in the gap 58 even if it is narrow.

Further, the two urging members 13 are arranged opposite to each other, so as to generate the urging force between the outer and the inner barrels 10 and 11 in a balanced manner.

Herein, the urging members 13 may be manufactured using a plate or a strip having an elongated cross sectional shape. Further, modification of angles of the bent portions or thickness of the wire enables changing the urging force.

The operating member 15 mainly consists of a clip 60, an outer cylindrical part 61, and an inner cylindrical part 62. The clip 60 has a clip body 60*a* and a protrusion 60*b*, whereby the flat plate of the outer barrel 10 is sandwiched between the outer cylindrical part 61 and the clip 60.

The outer cylindrical part 61 has external sizes in height and length substantially equal to those of an internal shape of the proximal opening 30 of the outer barrel 10, whereas the inner cylindrical part 62 has external sizes in height and length substantially equal to those of an internal shape of the proximal opening 40 of the inner barrel 11. As shown in FIGS. 3A and 3B, the operating member 15 is attached to the holder 1 such that the outer cylindrical part 61 is inserted into the proximal opening 30 of the outer barrel 10 and the inner cylindrical part 62 is inserted into the proximal opening 40 of the inner barrel 11. The operating member 15 is readily attached and detached.

Upon attachment of the operating member 15, a distal end of the outer cylindrical part 61 is brought into contact with the ribs 38 and 39 of the inner barrel 11. Therefore, pushing of the operating member 15 makes a displacement of the inner barrel 11.

Now, an assembling method and how to use the stick-shaped body advancing holder 1 will be described in detail below.

First, the chuck tube 12 is put on the distal part 33 through the opening 49 so that the protrusions 36 are located within the elongated holes 46.

The two urging members 13 are arranged adjacent to the ribs 48 at outside of the flat faces 50 and 52 having smaller width of the inner barrel 11.

Then, the inner barrel 11 is inserted into the outer barrel 10 with the inner barrel 11 inserted into the chuck tube 12 and the urging member 13 arranged thereon. The inner barrel 11 is inserted from the proximal opening 30 of the outer barrel 10 with the chuck tube 12 thereon.

The insertion of the inner barrel 11 into the outer barrel 10 is carried on until the protrusions 45 of the chuck tube 12 come to the throughholes 28 of the outer barrel 10. Herein, during the insertion, the protrusions 45 are kept inwardly deformed, but the insertion is readily performed because the protrusions 45 are placed in the throughholes 35 of the inner barrel 11.

On completion of the insertion, the outer barrel 10 and the chuck tube 12 are retained and the inner barrel 11 is prevented from being detached due to an engagement of the protrusions 36 and the elongated holes 46. Further, in this condition, the urging members 13 are slightly compressed, so as to generate the urging force in a direction in which the inner barrel 11 is headed toward the operating member 15 relative to the outer barrel 10.

Then, the operating member 15 is attached, so that the stick-shaped body advancing holder 1 is completed.

In using the holder 1, the stick-shaped body 90 is inserted into the holder 1 with the operating member 15 detached, and then the operating member 15 is attached thereto. The body is intermittently advanced by a knocking operation by which the inner barrel 11 is moved back and forth using the operating member 15. Then, the holder 1 is used with a distal end of the body 90 projected by a required length from the distal opening 31.

An advancing mechanism by the knocking operation is as follows.

As shown in FIGS. 3A and 3B, the outer barrel 10 and the chuck tube 12 are retained with the inner barrel 11 arranged therewithin. The urging force is generated between the outer and the inner barrels 10 and 11 in a direction in which the inner barrel 11 is headed toward the proximal end (the operation member 15).

Therefore, when the operation member 15 is not pushed, the inner barrel 11 is situated adjacent to the proximal end. Further, as shown in FIGS. 3A, 3B, 4A, and 4B, the chuck 56 is pushed by the chuck tube 12, so as to chuck the body 90. Normally, the operating member 15 is not pushed in using the holder 1, and in this condition, the body 90 is chucked and is prevented from being moved.

Figure 5:
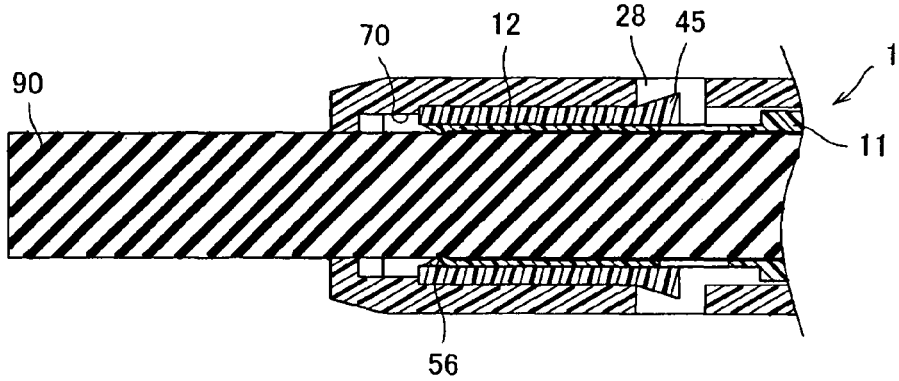
FIG. 5 is another cross section in the vicinity of the distal end of the combination of the present invention.

Pushing of the operating member 15 by a force larger than the urging force of the urging member 13 allows a relative movement of the inner barrel 11 in such a manner as being advanced relative to the outer barrel 10 and the chuck tube 12. During the relative movement, the body 90 is kept chucked, so as to be advanced in accordance with the movement of the inner barrel 11. Then, the holder 1 comes into a condition shown in FIG. 5.

Figure 6:
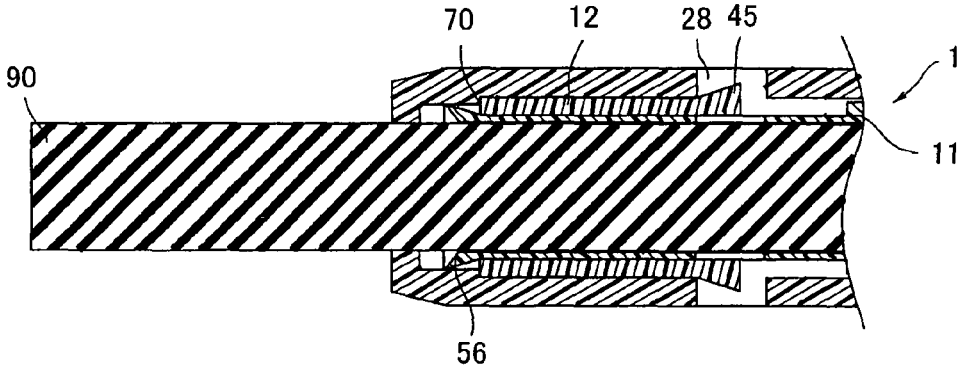
FIG. 6 is a still another cross section in the vicinity of the distal end of the combination of the present invention.

Further pushing of the operating member 15 forces the chuck tube 12 into contact with steps 70 of the outer barrel 10, thereby preventing advancement of the chuck tube 12 by the steps 70. Therefore, only the inner barrel 11 is advanced, and as shown in FIG. 6, the chuck 56 is released from the chuck tube 12, and whereby the body 90 is released from being chucked.

Subsequently, when pushing of the operating member 15 is stopped, the operating member 15 and the inner barrel 11 are relatively moved so as to be retracted relative to the outer barrel 10 by the urging force of the urging member 13. In the beginning of retraction, since the chuck tube 12 is moved together with the inner barrel 11, the body 90 is not chucked and is prevented from being moved relative to the outer barrel 10 because of a frictional resistance with the ribs 27*a* of the contacting part 27.

Further retraction of the operating member 15 prevents a relative movement of the protrusions 45 of the chuck tube 12 and the throughholes 28 of the outer barrel 10. Thus, the chuck tube 12 is prevented from being moved relative to the outer barrel 10 and the chuck 56 of the inner barrel 11 is retracted relative to the chuck tube 12, so as to chuck the body 90 again. That is, a relative relationship of each component reverts to the condition shown in FIGS. 4A and 4B.

In this way, a distance for which the body 90 is chucked in pushing the operating member 15 is longer than that in retracting the operating member 15. Therefore, one knocking operation by which the operating member 15 is pushed and retracted advances the body 90 by a predetermined distance.

By repetition of the knocking operations, the body 90 is advanced by a required length to be used. Herein, in the case that the body 90 is advanced more than necessary or in the case that the body is to be contained within the holder 1 after the use, the body 90 is retracted by pushing back the body 90 with maintaining the condition in which the operating member 15 is pushed.

The stick-shaped body 90 of the present embodiment is specifically a rubber eraser, whereby lines or letters written on a paper or the like are erased. The body 90 may employ another body and can employ a body that is to decrease in length by the use.

The invention claimed is:

1. A holder for holding a stick-shaped body so as to advance the body, comprising:

an outer barrel of a substantially tubular shape and having an inner surface;

an inner barrel of a substantially tubular shape, arranged within the outer barrel, and having an outer surface; and at least one urging member arranged between the outer and the inner barrels and adapted to exert an urging force on the inner barrel relative to the outer barrel in a predetermined direction, wherein the holder is adapted to perform a back and forth operation in which the inner barrel is moved against the urging force by an external force and reverts to the previous position by the urging force thereafter, the back and forth operation being adapted to advance the body placed within the inner barrel, wherein the urging member has a plurality of bent portions, the portions being deformable to generate the urging force, and wherein the inner surface of the outer barrel and the outer surface of the inner barrel each has at least one flat face, the urging member being arranged between the flat faces of the both surfaces, wherein substantially the entire urging member resides in a single plane.

2. The holder according to claim 1, wherein the urging member has a wave shape.

3. The holder according to claim 1, wherein the urging member is made of a body selected from a wire and a plate having a shape bent to define a plurality of portions bent in alternating directions.

4. The holder according to claim 1, wherein the urging member is manufactured by bending a body selected from a wire and a plate in repeating fashion with alternating bending directions.

5. The holder according to claim 1, wherein the inner barrel has a protrusion on the outer surface, so that the urging member exerts the urging force on the inner barrel by contacting with the protrusion.

6. The holder according to claim 1, wherein the flat face of the inner barrel has a plurality of longitudinal ribs, and wherein the urging member is arranged between the ribs and the outer barrel.

7. The holder according to claim 1, further comprising an operating member and a tube for a chuck, the operating member being adapted to transmit the external force to the inner barrel, and the tube being arranged between the inner and the outer barrels and being adapted to move in cooperation with the inner barrel, so as to advance the stick-shaped body by fastening and releasing of the body in accordance with the back and forth operation of the inner barrel.

8. The holder according to claim 1 wherein the entire urging member resides in the single plane.

9. A combination of the holder according to claim 1 and a stick-shaped body held in the holder, wherein the stick-shaped body is to decrease in length by the use.

10. The combination according to claim 9, the stick-shaped body being of a rectangular bar.

11. The combination according to claim 10, the stick-shaped body being an eraser.

12. A holder for holding a stick-shaped body so as to advance the body, the holder having a longitudinal axis and comprising:

an outer barrel of a substantially tubular shape and having an inner surface;

an inner barrel of a substantially tubular shape, arranged within the outer barrel, and having an outer surface; and at least one urging member arranged between the outer and the inner barrels, extending only partially around the longitudinal axis and adapted to exert an urging force on the inner barrel relative to the outer barrel in a predetermined direction, wherein the holder is adapted to perform a back and forth operation in which the inner barrel is moved against the urging force by an external force and reverts to the previous position by the urging force thereafter, the back and forth operation being adapted to advance the body placed within the inner barrel, wherein the urging member has a plurality of bent portions, the portions being deformable to generate the urging force, and wherein the inner surface of the outer barrel and the outer surface of the inner barrel each has at least one flat face, the urging member being arranged between the flat faces of the both surfaces.

13. A holder for holding a stick-shaped body so as to advance the body, comprising:

an outer barrel of a substantially tubular shape and having an inner surface;

an inner barrel of a substantially tubular shape, arranged within the outer barrel, and having an outer surface; and at least first and second urging members each arranged between the outer and the inner barrels and adapted to exert an urging force on the inner barrel relative to the outer barrel in a predetermined direction, wherein the holder is adapted to perform a back and forth operation in which the inner barrel is moved against the urging force by an external force and reverts to the previous position by the urging force thereafter, the back and forth operation being adapted to advance the body placed within the inner barrel, wherein each of the urging members has a plurality of bent portions, the portions being deformable to generate the urging force, and wherein the inner surface of the outer barrel and the outer surface of the inner barrel each has at least one flat face, the urging members each being arranged between the flat faces of the both surfaces.

14. The holder according to claim 13, wherein the outer barrel has at least two of the flat faces on the inner surface and the inner barrel has at least two of the flat faces on the outer surface, so that two of the urging members are arranged at opposed positions between the flat faces of the outer and the inner barrels.

15. The holder according to claim 13, wherein the outer and the inner barrels each are of a rectangular tubular shape, and wherein the outer barrel has four of the flat faces on the inner surface and the inner barrel has four of the flat faces on the outer surface, so that two of the urging members are arranged at opposed positions between the flat faces of the outer and the inner barrels.

16. The holder according to claim 15, wherein the outer barrel has a longitudinal direction, comprises a first part and a second part arranged in the longitudinal direction, and defines an internal space, wherein the outer barrel has a rectangular cross sectional shape of the internal space in each of the parts in cutting the outer barrel at a plane perpendicular to the longitudinal direction, the first part having at least one side larger than that of the second part, and wherein the urging member is arranged between the inner barrel and the first part of the outer barrel.

17. The holder according to claim 16, wherein the outer barrel has a step between the first and the second parts, wherein the inner barrel has a protrusion on the outer surface, and wherein the urging member is arranged between the step and the protrusion, so as to exert the urging force on the inner barrel by contacting with the protrusion.

18. The holder according to claim 13, wherein the outer and the inner barrels each are of a rectangular tubular shape having four flat plates, so that two of the urging members are arranged at opposed positions between the flat plates of the outer and the inner barrels.

19. A holder for holding a stick-shaped body so as to advance the body, comprising:

an outer barrel of a substantially tubular shape and having an inner surface;

an inner barrel of a substantially tubular shape, arranged within the outer barrel, and having an outer surface; and at least one urging member arranged between the outer and the inner barrels and adapted to exert an urging force on the inner barrel relative to the outer barrel in a predetermined direction, wherein the holder is adapted to perform a back and forth operation in which the inner barrel is moved against the urging force by an external force and reverts to the previous position by the urging force thereafter, the back and forth operation being adapted to advance the body placed within the inner barrel, wherein the urging member has a plurality of bent portions, the portions being deformable to generate the urging force, and wherein the inner surface of the outer barrel and the outer surface of the inner barrel each has at least one flat face, the urging member being arranged between the flat faces of the both surfaces, wherein the flat face of the inner barrel has a plurality of longitudinal ribs, and wherein the urging member is arranged between the ribs and the outer barrel.

* * * * *